US006034701A

United States Patent [19]

Drebus

[11] Patent Number: 6,034,701

[45] Date of Patent: Mar. 7, 2000

[54] METHOD AND SYSTEM FOR DISPLAYING MIXED SIZED FONTS FOR CHARACTER BASED DISPLAYS

[75] Inventor: John R. Drebus, Rochester Hills, Mich.

[73] Assignee: Electronic Data Systems Corporation, Plano, Tex.

[21] Appl. No.: 09/047,780

[22] Filed: Mar. 24, 1998

[51] Int. Cl.[7] ..... G09G 5/00

[52] U.S. Cl. ..... 345/467

[58] Field of Search ..... 345/467, 468, 345/469, 471

[56] References Cited

U.S. PATENT DOCUMENTS

| | | | |
|---|---|---|---|
| 5,867,172 | 2/1999 | Fujisawa et al. | 345/467 |
| 5,870,085 | 2/1999 | Laksono | 345/467 |
| 5,870,107 | 2/1999 | Fujisawa et al. | 345/467 |
| 5,920,324 | 7/1999 | Hasegawa et al. | 345/467 |
| 5,923,321 | 7/1999 | Huang | 345/467 |

OTHER PUBLICATIONS

Table of Contents, "Series 3000 Programming Implementation Manual," Document No. 59045–00–97, Document Version 1.2, Feb., 1992, Copyright © 1991 by Symbol Technologies, Incorporated, 12 pages.

Table of Contents, "Series 3000 Application Developer's Library," Document No. 61310–00–92, Version 2.2, Release Date: Mar., 1992, Copyright © 1992 by Symbol Technologies, Incorporated, 6 pages.

"Series 3000 Programming Implementation Manual," Document No. 59045–00–97, Document Version 1.2, Feb., 1992, pp. 14–10 through 14–11, pp. 4–1 through 4–21, 25 pages.

*Primary Examiner*—Phu K. Nguyen
*Assistant Examiner*—Cliff N. Vo
*Attorney, Agent, or Firm*—L. Joy Griebenow; Baker & Botts L.L.P.

[57] ABSTRACT

A method for displaying a representation of a character on a computer display includes receiving a first primary character string comprising at least one character selected from a primary character set. The method also includes receiving a first desired location for displaying a representation of the first primary character. The method also includes generating a plurality of intermediate character strings corresponding to the first primary character string. The intermediate character strings include at least one intermediate character selected from a predefined intermediate character set. The predefined intermediate character set is defined before receiving the first primary character string and includes a plurality of intermediate characters each corresponding to a fractional portion of a primary character in the primary character set. The method also includes displaying representations of the plurality of intermediate character strings on the computer display in a location sufficient to display the representation of the primary character string at the first desired location.

20 Claims, 8 Drawing Sheets

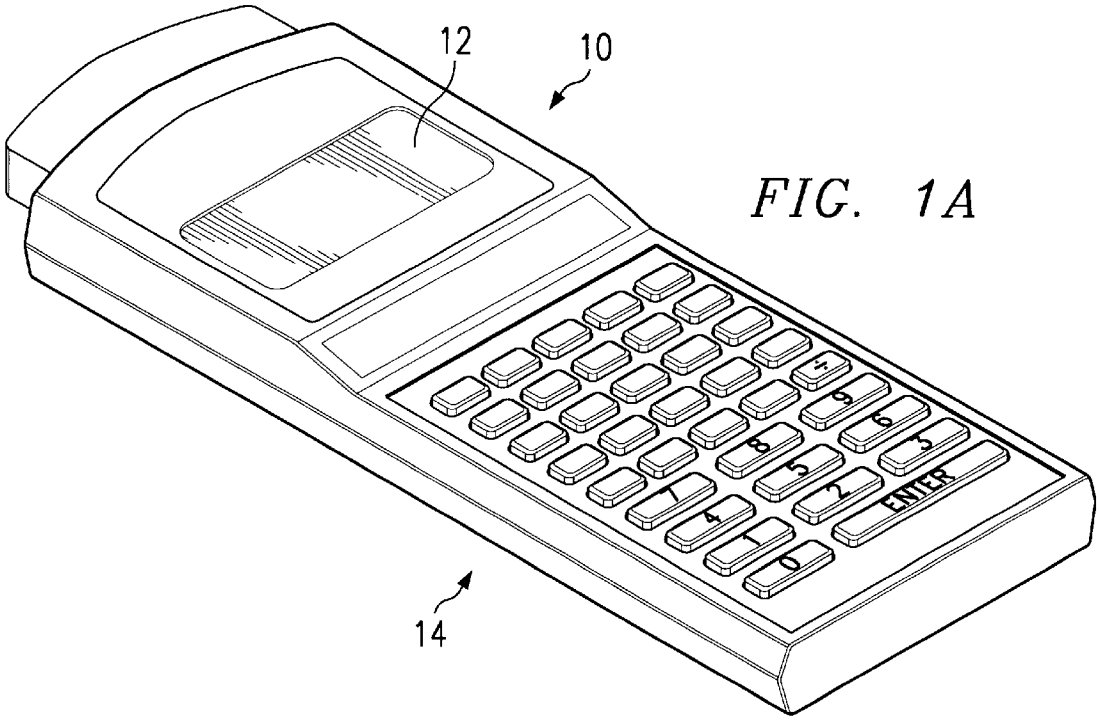
FIG. 1A
FIG. 1B
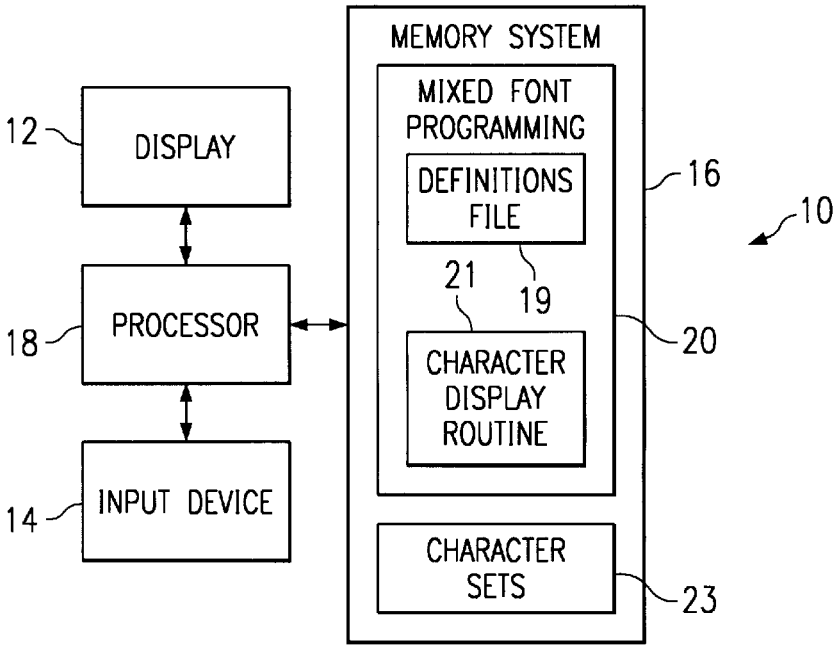

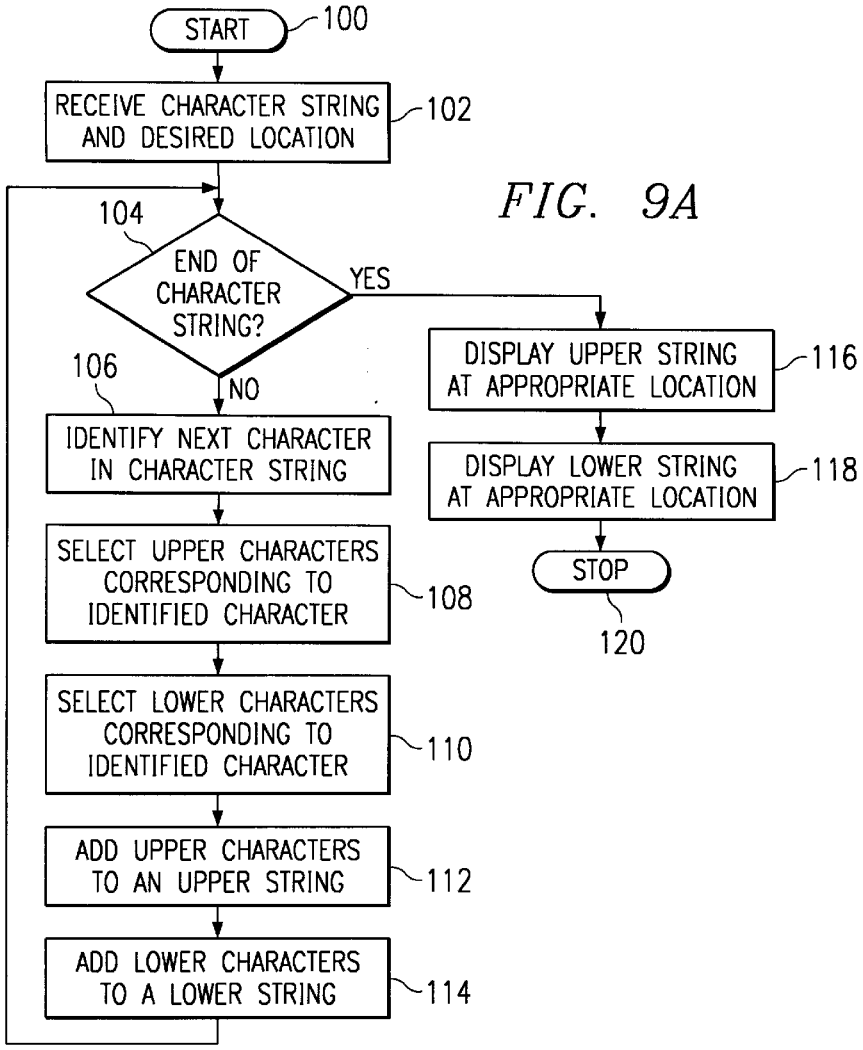
FIG. 9A
FIG. 9B
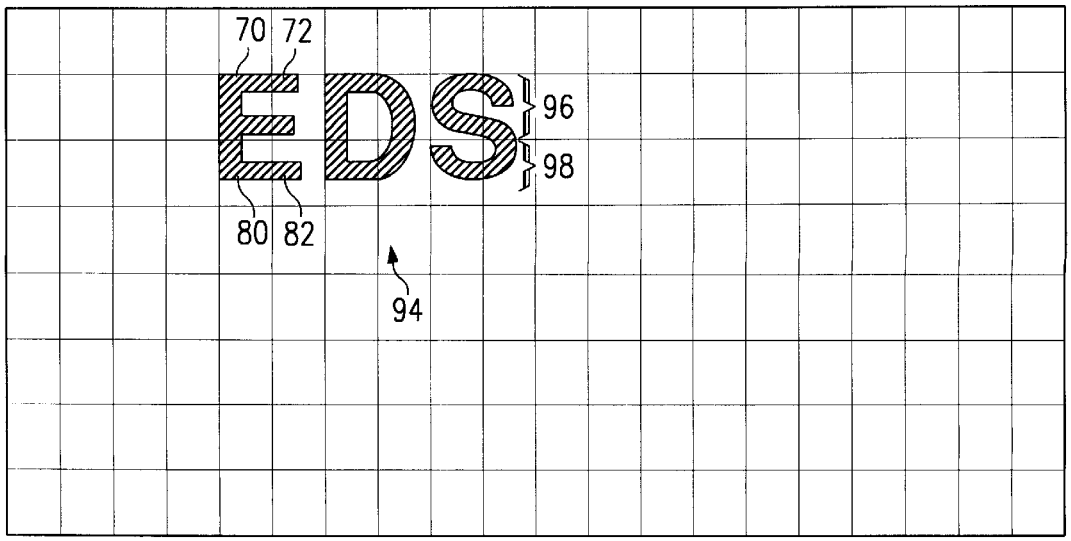

METHOD AND SYSTEM FOR DISPLAYING MIXED SIZED FONTS FOR CHARACTER BASED DISPLAYS

TECHNICAL FIELD OF THE INVENTION

This invention relates generally to the display of characters on a computer display and more particularly to a method and system for displaying mixed sized fonts for character based displays.

BACKGROUND OF THE INVENTION

Hand-held computers are used for a variety of purposes. For example, a hand-held computer may be used to determine and display a voltage in a similar manner to a volt meter, or it may be used to execute computer software. An example of a hand-held computer is a SYMBOL® Series 3000 personal data terminal. Many hand-held computers, as well as less portable computers, such as desktop personal computers, utilize a character based display. In a character based display, the display often includes a number of cells for displaying a representation of a character. Each cell is used to display a representation of a single character, such as an alphanumeric character. Such a cell may include a plurality of pixels which may be arranged in a plurality of columns and rows. However, most character based displays cannot display representations of arbitrary lines or curves.

Computing systems utilizing character based displays, such as hand-held computers, provide limited display capability. For example, in one implementation, it has been determined that representations of characters on a character based display can take on only one size concurrently. Such a limitation can be detrimental. For example, the user of a hand-held computer may wish to display a voltage associated with an electric voltage being measured in a larger size than associated data in other parts of the screen. Without the ability to display text concurrently in more than one size, either data that would otherwise be displayed must be omitted to allow display space for larger size representation of characters, or characters must sometimes be displayed in a size that is less than optimal for particular applications.

SUMMARY OF THE INVENTION

From the foregoing it may be appreciated that a need has arisen for a system and method for displaying characters having a mixed size font in a character based display. In accordance with the present invention, a system and method is provided that addresses the disadvantages and problems outlined above.

According to one embodiment of the present invention, a method for displaying a representation of a character on a computer display includes receiving a first primary character string. The first primary character string includes at least one character selected from a primary character set. The method also includes receiving a first desired location for displaying a representation of the first primary character string. The method also includes generating a plurality of intermediate character strings corresponding to the first primary character string. The intermediate character strings include at least one intermediate character selected from a predefined intermediate character set. The predefined intermediate character set is defined before receiving the first primary character string and includes a plurality of intermediate characters each corresponding to a fractional portion of a primary character in the primary character set. The method also includes displaying representations of the plurality of intermediate character strings on the computer display in locations sufficient to display the representation of the primary character string at the first desired location.

According to another embodiment of the present invention, a computerized system for displaying mixed sized fonts includes a storage medium, a processor coupled to the storage medium, a display coupled to the processor, and a computer program stored in the storage medium. The computer program is operable to run on the processor and is also operable to perform a series of steps associated with displaying representations of characters on the display. For example, the computer program is operable to receive a primary character string including at least one character selected from a primary character set and receive a desired location for displaying a representation of the primary character string. The computer program is also operable to form a plurality of intermediate character strings corresponding to the primary character string. Each intermediate character string includes a plurality of intermediate characters selected from an intermediate character set. The intermediate character set includes characters corresponding to a fractional portion of the primary characters in the primary character set. The computer program is also operable to display representations of the plurality of intermediate character strings on the computer display in locations sufficient to display the representation of the primary character string at the desired location.

The present invention provides numerous technical advantages. For example, the present invention allows a display of different size representations of characters on a character based display concurrently. Such a system allows the display of more important, or more immediate, data in a larger size while still allowing concurrent display of ancillary information in smaller size text. This concurrent display of mixed sized fonts allows the display of more information on a limited size screen without losing emphasis of more important data and does not require expensive graphics based displays. Other technical advantages are readily apparent to one skilled in the art from the following figures, descriptions, and claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which:

FIG. 1A is an isometric drawing of a computer system, according to the teachings of the present invention;

FIG. 1B is a block diagram of the computer system illustrated in FIG. 1A, showing functional blocks of the computer system;

FIG. 9A is a flowchart showing exemplary steps associated with representing a character string, according to the teachings of the present invention; and FIG. 9B is associated with FIG. 9A and illustrates a representation of a character string "EDS" according to the exemplary steps shown in FIG. 9A.

DETAILED DESCRIPTION OF THE INVENTION

Figure 3:
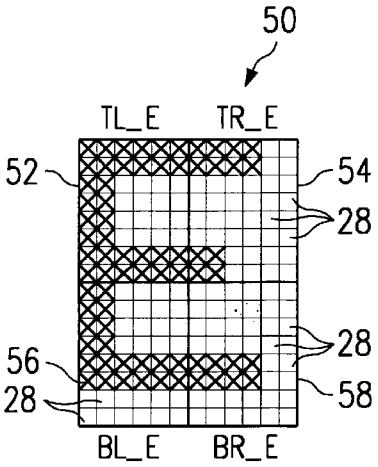
FIG. 3 is an illustration of the representation of the letter "E" shown in FIG. 2, showing the division of the representation of the "E" into four components.

Embodiments of the present invention and their advantages are best understood by referring to FIGS. 1 through 9B of the drawings, like numerals being used for like and corresponding parts of the various drawings.

FIG. 1A is an isometric drawing of a computer system 10. Computer system 10 includes a display 12 for displaying representations of characters. In the embodiment illustrated in FIG. 1A, display 12 is a character based display. In a character based display, the display utilizes a number of cells, with each cell conventionally used to display a single character. Computer system 10 also includes an input device 14 for providing information to computer system 10. In the embodiment illustrated in FIG. 1A, input device 14 comprises a keyboard having a plurality of keys associated with alphanumeric characters. Computer system 10 may utilize standard DOS programming tools, including C and C++ compilers; however, other operating systems and programming tools may be incorporated without departing from the scope of the present invention. One example of a computer system appropriate for use with the present invention is a SYMBOL® Series 3000 portable data terminal. A SYMBOL® Series 3000 portable data terminal is described in *Series* 3000 *Programming Implementation Manual,* which is incorporated herein by reference.

Display 12 of computer system 10 includes an eight by twenty cell character display for displaying representations of characters; however, other suitable displays may be utilized. Computer system 10 also includes a memory system for storing data and computer software and a processor for manipulating data and executing computer software (not explicitly shown in FIG. 1A). A memory system, associated programming, and a processor associated with computer system 10 is described in greater detail below in conjunction with FIG. 1B. According to the invention, computer system 10 may display mixed sized representations of characters on display 12, as discussed in greater detail below. The ability to display mixed sized representations of characters allows the display of more important data in a more conspicuous manner than less important ancillary data, but it also allows the concurrent display of both types of data.

FIG. 1B is a block diagram of computer system 10, according to the teachings of the present invention, showing functional blocks of computer system 10. As illustrated, computer system 10 includes a memory system 16 for storing data and programming. A processor 18 is coupled to display 12, input device 14, and memory system 16. Processor 18 may receive information from a user of computer system 10 through input device 14 and may execute display of information to a user through display 12. Furthermore, processor 18 may execute programming stored in memory system 16, such as mixed font programming 20. Processor 18 may include any suitable processor for use with a computing system. Memory system 16 may include both random access memory, read-only memory, and other suitable types of memory. Mixed font programming 20, in cooperation with the remainder of computer system 10 allows the display of mixed size representations of characters on display 12. In the embodiment of the invention illustrated in FIG. 1B, mixed font programming 20 includes a header, or definitions file 19, and a character display routine 21. As described in greater detail below, definitions file 19 associates a plurality of characters with more easily recognizable variable names to facilitate display of mixed sized fonts, and character display routine 21 displays representations of characters on display 12 by, in one embodiment, combining a plurality of intermediate characters. Memory system 16 also includes character sets 23, which may be stored in mixed font programming 20 or other suitable locations in memory system 16. Character sets 23 provide characters for computer system 10 that may be displayed on display 12. Mixed font programming 20 is described in greater detail below.

Figure 2:
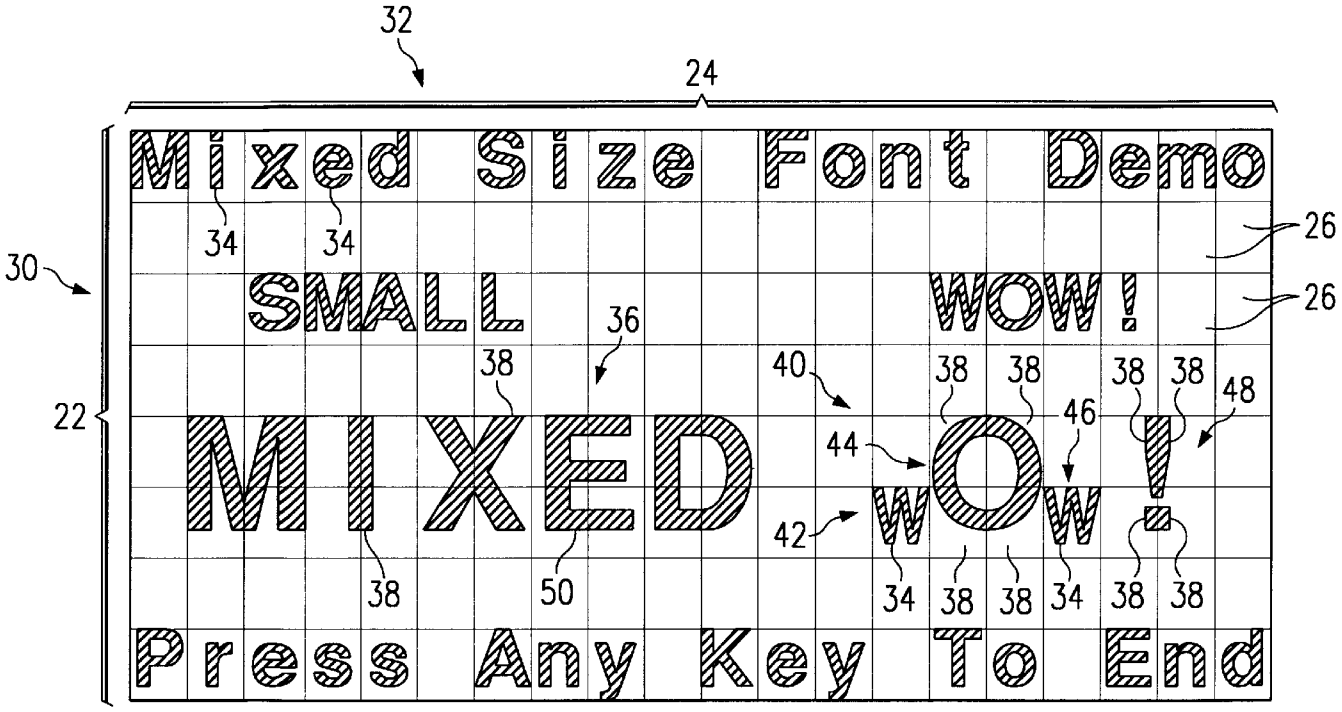
FIG. 2 is an illustration of a computer display of the computer system illustrated in FIGS. 1A and 1B, showing the representation of characters utilizing mixed sized fonts, according to the teachings of the present invention.

FIG. 2 is an illustration of computer display 12 showing the representation of characters utilizing mixed sized fonts, according to the teachings of the present invention. As illustrated, display 12 includes a plurality of rows 22 and a plurality of columns 24 of cells 26. According to one embodiment of the invention, display 12 comprises eight rows 22 and twenty columns 24 of cells 26. Cell 26 includes a fixed number of pixels 28, as illustrated in FIG. 3. In the embodiment illustrated in FIG. 3, each cell 26 comprises 48 pixels 28 configured in eight rows 22 and six columns 24; however, other suitable configurations and numbers of pixels 28 may be utilized without departing from the scope of the present invention.

Each cell 26 may display a representation of one character by illuminating appropriate pixels 28 to create a pattern within a cell 26 corresponding to a representation of a particular character. A location for displaying the representation of a character or a character string may be identified by the row 22 and the column 24 at which the character or character string is to begin. Alternative locating systems may also be used, including providing the row 22 and column 24 corresponding to the center of the location at which a character string is to be displayed.

As illustrated in FIG. 2, a representation 32 of a character string "Mixed" is displayed in a location denoted by a reference numeral 30. Representation 32 of the character string "mixed" comprises a plurality of representations 34 of primary characters, such as primary characters "m," "i," "x," "e," and "d". Primary characters 34 represent characters or numbers associated with a standard character set. Representation 32 of the character string "mixed" is displayed in a small font size. In this embodiment, a small font size corresponds to a font size that requires one cell for display of each primary character.

FIG. 2 also displays representations of character strings in a large font size. For example, representation 36 of the character string "MIXED" is displayed in a large font size. In this embodiment, a large font size corresponds to a font size that requires four cells to display each primary character. Representation 36 of the character string "MIXED" in a large font size includes a plurality of representations 38 of intermediate characters. According to the invention, representations 38 of intermediate characters correspond to a representation of a fractional portion of a primary character. In the example illustrated in FIG. 2, representations 38 of intermediate characters each represent one-quarter of a primary character. For example, a representation 50 of the primary character "E" includes representation of four intermediate characters corresponding to the quarter sections of the primary character "E". Representation 50 of the primary character "E" corresponds to a large font size and is described in greater detail below in conjunction with FIG. 3.

According to the invention a single character string may be represented concurrently in both large and small font sizes by combining a plurality of representations of character strings of different sizes. For example, representation 40 of the character string "WOW!" includes a representation of a plurality of character strings 42, 44, 46, and 48. Representations 42 and 46 of the "w" and owe character strings each include representation 34 of the primary character "w". Representations 44 and 48 of the character strings each include four representations 38 of intermediate characters. The representations 38 of intermediate characters that are used to form representation 44 of the primary character "O" each correspond to a quarter portion of the primary character "O". The representations 38 that are used to form representation 48 of the primary character "!" correspond to quarter portions of the primary character "!." Representations 42 and 46 each include representations of the primary character "w" in only one cell, and representations 44 and 48 each include representations of the primary characters "O" and "!", respectively, in four cells. Thus, representations 42 and 46 correspond to characters, and character strings, displayed in a small font, and representations 44 and 48 correspond to characters, and character strings, displayed in a large font. Therefore, by combining representatives 42, 44, 46, and 48, a single representation 40 of a character string having different sized fonts may be effected.

According to the invention, a plurality of representations 38 of intermediate characters are displayed in locations to effect a representation of a character in a large font. In addition, on the same display 12, a plurality of representations 34 of characters in a small font are displayed in locations to produce a character string, such as character string 32, having a small font. Thus, by displaying representations of intermediate characteristics that correspond to fractional portions of primary characters, representations of character strings may be displayed in both large and small font sizes concurrently. One method for forming an intermediate character and displaying a plurality of intermediate characters in a way to represent a primary character is described below in conjunction with FIGS. 3 through 9B.

FIG. 3 is an illustration of representation 50 of the letter "E" shown in FIG. 2, showing the division of representation 50 of the letter "E" into four components. As shown in FIG. 3, representation 50 includes a representation 52 corresponding to an intermediate character corresponding to a top left portion of the primary character "E," a representation 54 corresponding to an intermediate character corresponding to a top right portion of "E," a representation 56 corresponding to an intermediate character corresponding to a bottom left portion of "E," and a representation 58 corresponding to an intermediate character corresponding to a bottom right portion of "E." By locating representations 52, 54, 56, and 58 together in the manner illustrated in FIG. 3, representation 50 of a primary character "E" may be displayed on display 12 in a large font.

As shown, each intermediate character is displayed in one cell 26 of display 12 with each cell 26 having a plurality of pixels 28. In the embodiment illustrated in FIG. 3, each cell 26 contains eight rows 22 and six columns 24 of pixels 28; however, other numbers of pixels and configurations of pixels may be used.

In the illustrated embodiment, the primary character "E" is represented by four representations 52, 54, 56, and 58 of intermediate characters corresponding to fractional portions of the primary character "E." However, other suitable numbers of intermediate characters may be used to represent a primary character in a font size that is greater than one cell. For example, nine intermediate characters may be arranged in a configuration of three rows 22 and three columns 24 to display an even larger representation of the letter "E." As described above, the embodiment illustrated in FIG. 2 requires four cells to represent a character in a large font. Each character of an alphabet may be represented in such a manner by a plurality of intermediate characters arranged to form a primary character.

FIGS. 4 through 8 illustrate an example primary character set 60 including primary characters 62 corresponding to the numbers 0 through 9 and the letters "A" through "Z." FIGS. 4 through 8 also illustrate an example intermediate character set 64 including intermediate characters 66 corresponding to the primary character set 60 illustrated in FIGS. 4 through 8. Intermediate character set 64 includes four intermediate characters 66 for each primary character 62 in the primary character set 60. It should be appreciated that FIGS. 2, 3, and 9B illustrate example representations of the actual characters illustrated in FIGS. 4 through 8, and FIGS. 4 through 8 illustrate the actual characters of primary character set 60 and intermediate character set 64.

Intermediate characters such as intermediate characters 66 may be formed by determining the appropriate pixels 28 within a cell that must be illuminated to represent the intermediate character. One example of the creation of such a font is described in Chapter 4 "Font Build" of *Series* 3000 *Programming Implementation Manual.*

To facilitate use of intermediate characters 66 to form primary characters 62, intermediate character 66 may be assigned to replace infrequently used characters in an ASCII character set. This assignment is achieved by assigning the ASCII code for infrequently used ASCII characters to intermediate characters 66. The assignment of ASCII code intermediate characters 66 is described below with reference to Table 1.

The below Table 1 illustrates a standard ASCII character set.

TABLE 1

ASCII CHARACTER SET

| Ctrl | Dec | Hex | Char | Code |
|---|---|---|---|---|
| ^@ | 0 | 00 | | NUL |
| ^A | 1 | 01 | ☺ | SOH |
| ^B | 2 | 02 | | STX |
| ^C | 3 | 03 | ♥ | ETX |
| ^D | 4 | 04 | ♦ | EOT |
| ^E | 5 | 05 | ♣ | ENQ |
| ^F | 6 | 06 | ♠ | ACK |
| ^G | 7 | 07 | ◆ | BEL |
| ^H | 8 | 08 | ◘ | BS |
| ^I | 9 | 09 | | HT |
| ^J | 10 | 0A | ◙ | LF |
| ^K | 11 | 0B | ♂ | VT |
| ^L | 12 | 0C | ♀ | FF |
| ^M | 13 | 0D | ♪ | CR |
| ^N | 14 | 0E | ♫ | SO |
| ^O | 15 | 0F | ☼ | SI |
| ^P | 16 | 10 | ► | DLE |
| ^Q | 17 | 11 | ◄ | DC1 |
| ^R | 18 | 12 | ↕ | DC2 |
| ^S | 19 | 13 | !! | DC3 |
| ^T | 20 | 14 | ¶ | DC4 |
| ^U | 21 | 15 | § | NAK |
| ^V | 22 | 16 | ■ | SYN |
| ^W | 23 | 17 | ↨ | ETB |
| ^X | 24 | 18 | ↑ | CAN |
| ^Y | 25 | 19 | ↓ | EM |
| ^Z | 26 | 1A | → | SUB |
| ^[ | 27 | 1B | ← | ESC |
| ^\ | 28 | 1C | ∟ | FS |
| ^] | 29 | 1D | ↔ | GS |
| ^^ | 30 | 1E | ▲ | RS |
| ^_ | 31 | 1F | ▼ | US |
| | 32 | 20 | | |
| | 33 | 21 | ! | |
| | 34 | 22 | " | |
| | 35 | 23 | # | |
| | 36 | 24 | $ | |
| | 37 | 25 | % | |
| | 38 | 26 | & | |
| | 39 | 27 | ' | |
| | 40 | 28 | ( | |
| | 41 | 29 | ) | |
| | 42 | 2A | * | |
| | 43 | 2B | + | |
| | 44 | 2C | , | |
| | 45 | 2D | — | |
| | 46 | 2E | . | |
| | 47 | 2F | / | |
| | 48 | 30 | 0 | |
| | 49 | 31 | 1 | |
| | 50 | 32 | 2 | |
| | 51 | 33 | 3 | |
| | 52 | 34 | 4 | |
| | 53 | 35 | 5 | |
| | 54 | 36 | 6 | |
| | 55 | 37 | 7 | |
| | 56 | 38 | 8 | |
| | 57 | 39 | 9 | |
| | 58 | 3A | : | |
| | 59 | 3B | ; | |
| | 60 | 3C | < | |
| | 61 | 3D | = | |
| | 62 | 3E | > | |
| | 63 | 3F | ? | |
| | 64 | 40 | @ | |
| | 65 | 41 | A | |
| | 66 | 42 | B | |
| | 67 | 43 | C | |
| | 68 | 44 | D | |
| | 69 | 45 | E | |
| | 70 | 46 | F | |

TABLE 1-continued

ASCII CHARACTER SET

| Ctrl | Dec | Hex | Char | Code |
|---|---|---|---|---|
| | 71 | 47 | G | |
| | 72 | 48 | H | |
| | 73 | 49 | I | |
| | 74 | 4A | J | |
| | 75 | 4B | K | |
| | 76 | 4C | L | |
| | 77 | 4D | M | |
| | 78 | 4E | N | |
| | 79 | 4F | O | |
| | 80 | 50 | P | |
| | 81 | 51 | Q | |
| | 82 | 52 | R | |
| | 83 | 53 | S | |
| | 84 | 54 | T | |
| | 85 | 55 | U | |
| | 86 | 56 | V | |
| | 87 | 57 | W | |
| | 88 | 58 | X | |
| | 89 | 59 | Y | |
| | 90 | 5A | Z | |
| | 91 | 5B | [ | |
| | 92 | 5C | \ | |
| | 93 | 5D | ] | |
| | 94 | 5E | ^ | |
| | 95 | 5F | _ | |
| | 96 | 60 | ' | |
| | 97 | 61 | a | |
| | 98 | 62 | b | |
| | 99 | 63 | c | |
| | 100 | 64 | d | |
| | 101 | 65 | e | |
| | 102 | 66 | f | |
| | 103 | 67 | g | |
| | 104 | 68 | h | |
| | 105 | 69 | i | |
| | 106 | 6A | j | |
| | 107 | 6B | k | |
| | 108 | 6C | l | |
| | 109 | 6D | m | |
| | 110 | 6E | n | |
| | 111 | 6F | o | |
| | 112 | 70 | p | |
| | 113 | 71 | q | |
| | 114 | 72 | r | |
| | 115 | 73 | s | |
| | 116 | 74 | t | |
| | 117 | 75 | u | |
| | 118 | 76 | v | |
| | 119 | 77 | w | |
| | 120 | 78 | x | |
| | 121 | 79 | y | |
| | 122 | 7A | z | |
| | 123 | 7B | { | |
| | 124 | 7C | \| | |
| | 125 | 7D | } | |
| | 126 | 7E | ~ | |
| | 127 | 7F | ⌂ | |
| | 128 | 80 | Ç | |
| | 129 | 81 | ü | |
| | 130 | 82 | é | |
| | 131 | 83 | â | |
| | 132 | 84 | ä | |
| | 133 | 85 | à | |
| | 134 | 86 | å | |
| | 135 | 87 | ç | |
| | 136 | 88 | ê | |
| | 137 | 89 | ë | |
| | 138 | 8A | è | |
| | 139 | 8B | ï | |
| | 140 | 8C | î | |

TABLE 1-continued

ASCII CHARACTER SET

| Ctrl | Dec | Hex | Char | Code |
|---|---|---|---|---|
| | 141 | 8D | ì | |
| | 142 | 8E | Ä | |
| | 143 | 8F | Å | |
| | 144 | 90 | É | |
| | 145 | 91 | æ | |
| | 146 | 92 | Æ | |
| | 147 | 93 | ô | |
| | 148 | 94 | ö | |
| | 149 | 95 | ò | |
| | 150 | 96 | û | |
| | 151 | 97 | ù | |
| | 152 | 98 | ÿ | |
| | 153 | 99 | Ö | |
| | 154 | 9A | Ü | |
| | 155 | 9B | ¢ | |
| | 156 | 9C | £ | |
| | 157 | 9D | ¥ | |
| | 158 | 9E | ₧ | |
| | 159 | 9F | ƒ | |
| | 160 | A0 | á | |
| | 161 | A1 | í | |
| | 162 | A2 | ó | |
| | 163 | A3 | ú | |
| | 164 | A4 | ñ | |
| | 165 | A5 | Ñ | |
| | 166 | A6 | ª | |
| | 167 | A7 | º | |
| | 168 | A8 | ¿ | |
| | 169 | A9 | ⌐ | |
| | 170 | AA | ¬ | |
| | 171 | AB | ½ | |
| | 172 | AC | ¼ | |
| | 173 | AD | ¡ | |
| | 174 | AE | « | |
| | 175 | AF | » | |
| | 176 | B0 | ░ | |
| | 177 | B1 | ▒ | |
| | 178 | B2 | ▓ | |
| | 179 | B3 | │ | |
| | 180 | B4 | ┤ | |
| | 181 | B5 | ╡ | |
| | 182 | B6 | ╢ | |
| | 183 | B7 | ╖ | |
| | 184 | B8 | ╕ | |
| | 185 | B9 | ╣ | |
| | 186 | BA | ║ | |
| | 187 | BB | ╗ | |
| | 188 | BC | ╝ | |
| | 189 | BD | ╜ | |
| | 190 | BE | ╛ | |
| | 191 | BF | ┐ | |
| | 192 | C0 | └ | |
| | 193 | C1 | ┴ | |
| | 194 | C2 | ┬ | |
| | 195 | C3 | ├ | |
| | 196 | C4 | ─ | |
| | 197 | C5 | ┼ | |
| | 198 | C6 | ╞ | |
| | 199 | C7 | ╟ | |
| | 200 | C8 | ╚ | |
| | 201 | C9 | ╔ | |
| | 202 | Ca | ╩ | |
| | 203 | CB | ╦ | |
| | 204 | CC | ╠ | |
| | 205 | CD | ═ | |
| | 206 | CE | ╬ | |
| | 207 | CF | ╧ | |
| | 208 | D0 | ╨ | |
| | 209 | D1 | ╤ | |
| | 210 | D2 | ╥ | |
| | 211 | D3 | ╙ | |
| | 212 | D4 | ╘ | |
| | 213 | D5 | ╒ | |
| | 214 | D6 | ╓ | |
| | 215 | D7 | ╫ | |
| | 216 | D8 | ╪ | |
| | 217 | D9 | ┘ | |
| | 218 | Da | ┌ | |
| | 219 | DB | █ | |
| | 220 | DC | ▄ | |
| | 221 | DD | ▌ | |
| | 222 | DE | ▐ | |
| | 223 | DF | ▀ | |
| | 224 | E0 | α | |
| | 225 | E1 | β | |
| | 226 | E2 | Γ | |
| | 227 | E3 | π | |
| | 228 | E4 | Σ | |
| | 229 | E5 | σ | |
| | 230 | E6 | µ | |
| | 231 | E7 | τ | |
| | 232 | E8 | Φ | |
| | 233 | E9 | Θ | |
| | 234 | EA | Ω | |
| | 235 | EB | δ | |
| | 236 | EC | ∞ | |
| | 237 | ED | φ | |
| | 238 | EE | ε | |
| | 239 | EF | ∩ | |
| | 240 | F0 | ≡ | |
| | 241 | F1 | ± | |
| | 242 | F2 | ≥ | |
| | 243 | F3 | ≤ | |
| | 244 | F4 | ⌠ | |
| | 245 | F5 | ⌡ | |
| | 246 | F6 | ÷ | |
| | 247 | F7 | ≈ | |
| | 248 | F8 | ° | |
| | 249 | F9 | ∙ | |
| | 250 | FA | · | |
| | 251 | FB | √ | |
| | 252 | FC | ⁿ | |
| | 253 | FD | ² | |
| | 254 | FE | ■ | |
| | 255 | FF | | |

The shaded characters correspond to characters that may be infrequently used and that are replaced in one embodiment of the invention with intermediate characters 66. As illustrated in FIGS. 4 through 8, each intermediate character is assigned both a decimal and hexadecimal code corresponding to its designation in the ASCII character set shown in Table 1. For example, in FIG. 4, the lower right portion of the character "4" is represented by the intermediate character 66 denoted by 141 and hexadecimal 8D. Therefore, a modified ASCII character set that includes the characters in primary character set 60 and intermediate character set 64 is formed to provide a plurality of characters that may be represented on display 12. Decimal and hexadecimal codes appearing in parentheses in FIGS. 4 through **8*n* designate that a particular intermediate character 66 may be used to form a portion of more than one primary character 62. This modified ASCII character set may be stored within character set 23, illustrated in FIG. 1B. As described above, representations of primary characters 34 may be displayed concurrently on display 12 in both small and large font by appropriate use of primary characters 62 and intermediate characters 66 in character sets 23**.

Figure 4:
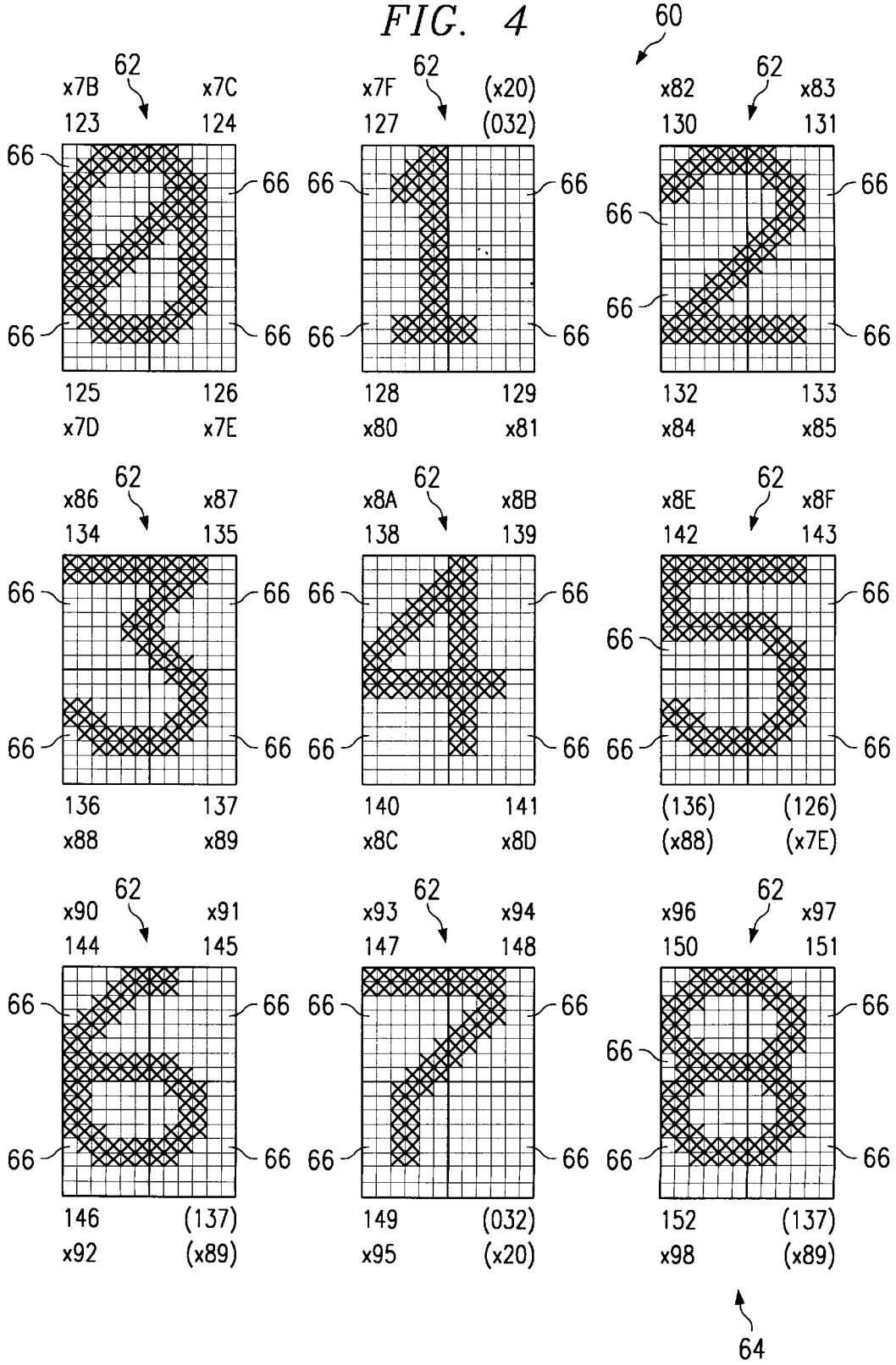
FIG. 4 illustrates the alphanumeric characters 0 through 8 and four intermediate characters for each alphanumeric character 0 through 8, which form a part of a primary character set and an intermediate character set, respectively, according to the teachings of the present invention.

As described above, according to one embodiment of the invention, mixed font programming 20 includes a header, or definitions file 19. Definitions file 19 defines variables in mixed font programming 20 that correspond to each intermediate character 66. A purpose of defining variables in mixed font programming 20 to correspond to intermediate characters 66 is to provide variable names corresponding to the intermediate characters 66 rather than utilizing the associated ASCII hexadecimal code associated with each intermediate character 66. As an example, the variable name "TL_2" is assigned to the character represented by the hexadecimal ASCII code 82, which as illustrated in FIG. 4 corresponds to the intermediate character 66 corresponding to the top left portion of the primary character 62 "2". An example definition file 19, which is entitled "MIXDSIZE.H," is written in the C-programming language and is provided below in Table 2.

TABLE 2

Example of Definitions File 19

```
/* MIXDSIZE.H
File Name: mixdsize.h
Programmer: J. Drebus
This header file is used in conjunction with the MIXDSIZE() function
which allows the mixing of character sizes in the character screen
display of a handheld computer.
The large characters are constructed using four smaller "tiles" that
have been defined in the font file MIXDSIZE.FNT. Each tile is
referenced in the MIXDSIZE function by its quandrant abbreviation:
TL — top left
TR — top right
BL — bottom left
BR — bottom right
followed by an underscore and the character which is being constucted.
The hex number corresponding to the font character of the tile is
assigned. */
#define BLANK    "\x20"   /* blank */
#define TL_0     "\x7B"   /* number 0 */
#define TR_0     "\x7C"
#define BL_0     "\x7D"
#define BR_0     "\x7E"
#define TL_1     "\x7F"   /* number 1 */
#define TR_1     "\x20"
#define BL_1     "\x80"
#define BR_1     "\x81"
#define TL_2     "\x82"   /* number 2 */
#define TR_2     "\x83"
#define BL_2     "\x84"
#define BR_2     "\x85"
#define TL_3     "\x86"   /* number 3 */
#define TR_3     "\x87"
#define BL_3     "\x88"
#define BR_3     "\x89"
#define TL_4     "\x8A"   /* number 4 */
#define TR_4     "\x8B"
#define BL_4     "\x8C"
#define BR_4     "\x8D"
#define TL_5     "\x8E"   /* number 5 */
```

TABLE 2-continued

Example of Definitions File 19

```
#define TR_5     "\x8F"
#define BL_5     "\x88"
#define BR_5     "\x7E"
#define TL_6     "\x90"   /* number 6 */
#define TR_6     "\x91"
#define BL_6     "\x92"
#define BR_6     "\x89"
#define TL_7     "\x93"   /* number 7 */
#define TR_7     "\x94"
#define BL_7     "\x95"
#define BR_7     "\x20"
#define TL_8     "\x96"   /* number 8 */
#define TR_8     "\x97"
#define BL_8     "\x98"
#define BR_8     "\x89"
#define TL_9     "\x99"   /* number 9 */
#define TR_9     "\x9A"
#define BL_9     "\x9B"
#define BR_9     "\x9C"
#define TL_A     "\x9D"   /* letter A */
#define TR_A     "\x9E"
#define BL_A     "\x9F"
#define BR_A     "\xA0"
#define TL_B     "\xA1"   /* letter B */
#define TR_B     "\x97"
#define BL_B     "\xA2"
#define BR_B     "\x98"
#define TL_C     "\xA3"   /* letter C */
#define TR_C     "\xA4"
#define BL_C     "\x92"
#define BR_C     "\xA5"
#define TL_D     "\xA6"   /* letter D */
#define TR_D     "\xA7"
#define BL_D     "\xA8"
#define BR_D     "\x9C"
#define TL_E     "\xA1"   /* letter E */
#define TR_E     "\xA9"
#define BL_E     "\xA2"
#define BR_E     "\xAA"
#define TL_F     "\xA1"   /* letter F */
#define TR_F     "\xA9"
#define BL_F     "\x9F"
#define BR_F     "\x20"
#define TL_G     "\xAB"   /* letter G */
#define TR_G     "\xAC"
#define BL_G     "\x92"
#define BR_G     "\x7E"
#define TL_H     "\xAD"   /* letter H */
#define TR_H     "\xAE"
#define BL_H     "\x9F"
#define BR_H     "\xA0"
#define TL_I     "\xAF"   /* letter I */
#define TR_I     "\xB0"
#define BL_I     "\x80"
#define BR_I     "\x81"
#define TL_J     "\xB1"   /* letter J */
#define TR_J     "\xB2"
#define BL_J     "\xB5"
#define BR_J     "\xB6"
#define TL_K     "\xB7"   /* letter K */
#define TR_K     "\xB8"
#define BL_K     "\xBD"
#define BR_K     "\xBE"
#define TL_L     "\x8B"   /* letter L */
#define TR_L     "\x20"
#define BL_L     "\xA2"
#define BR_L     "\xAA"
#define TL_M     "\xC6"   /* letter M */
#define TR_M     "\xC7"
#define BL_M     "\x9F"
#define BR_M     "\xA0"
#define TL_N     "\xCF"   /* letter N */
#define TR_N     "\xD0"
#define BL_N     "\xD1"
#define BR_N     "\xD2"
#define TL_O     "\xA3"   /* letter O */
#define TR_O     "\xD3"
```

TABLE 2-continued

Example of Definitions File 19

```
#define BL_O      "\x92"
#define BR_O      "\x7E"
#define TL_P      "\xA1"   /* letter P */
#define TR_P      "\x83"
#define BL_P      "\x9F"
#define BR_P      "\x20"
#define TL_Q      "\xA3"   /* letter Q */
#define TR_Q      "\xD3"
#define BL_Q      "\xD4"
#define BR_Q      "\xD5"
#define TL_R      "\xA1"   /* letter R */
#define TR_R      "\x83"
#define BL_R      "\xBD"
#define BR_R      "\xBE"
#define TL_S      "\x99"   /* letter S */
#define TR_S      "\xD6"
#define BL_S      "\xD7"
#define BR_S      "\x89"
#define TL_T      "\xD8"   /* letter T */
#define TR_T      "\xDB"
#define BL_T      "\xDC"
#define BR_T      "\x20"
#define TL_U      "\x8B"   /* letter U */
#define TR_U      "\xDD"
#define BL_U      "\x92"
#define BR_U      "\x7E"
#define TL_V      "\x8B"   /* letter V */
#define TR_V      "\xDD"
#define BL_V      "\xDE"
#define BR_V      "\x9C"
#define TL_W      "\xDF"   /* letter W */
#define TR_W      "\xDD"
#define BL_W      "\xE0"
#define BR_W      "\x7E"
#define TL_X      "\xE1"   /* letter X */
#define TR_X      "\xE2"
#define BL_X      "\xE3"
#define BR_X      "\xE4"
#define TL_Y      "\xE5"   /* letter Y */
#define TR_Y      "\xE6"
#define BL_Y      "\xE7"
#define BR_Y      "\xE8"
#define TL_Z      "\x93"   /* letter Z */
#define TR_Z      "\x94"
#define BL_Z      "\xE9"
#define BR_Z      "\xAA"
#define TL_DEC    "\x20"   /* decimal point */
#define TR_DEC    "\x20"
#define BL_DEC    "\xEA"
#define BR_DEC    "\xEA"
#define TL_COM    "\x20"   /* comma */
#define TR_COM    "\x20"
#define BL_COM    "\xEC"
#define BR_COM    "\xED"
#define TL_NEG    "\xEE"   /* negative sign */
#define TR_NEG    "\xEF"
#define BL_NEG    "\x20"
#define BR_NEG    "\x20"
#define TL_POS    "\xF0"   /* positive sign*/
#define TR_POS    "\xF1"
#define BL_POS    "\xF2"
#define BR_POS    "\x20"
#define TL_NUM    "\xF3"   /* number (or pound) */
#define TR_NUM    "\xF4"
#define BL_NUM    "\xF5"
#define BR_NUM    "\x8D"
#define TL_DOL    "\xF6"   /* dollar sign */
#define TR_DOL    "\xF7"
#define BL_DOL    "\xF8"
#define BR_DOL    "\xF9"
#define TL_PER    "\xFA"   /* percent sign */
#define TR_PER    "\xFB"
#define BL_PER    "\xFC"
#define BR_PER    "\xFD"
#define TL_EXC    "\xFE"   /* exclamation point */
#define TR_EXC    "\x20"
#define BL_EXC    "\xFF"
```

TABLE 2-continued

Example of Definitions File 19

```
#define BR_EXC    "\x20"
#define TL_QUE    "\x82"   /* question mark */
#define TR_QUE    "\x83"
#define BL_QUE    "\xFF"
#define BR_QUE    "\xE8"
```

Thus, definitions file 19 allows other portions of mixed font programming 20 to utilize intermediate characters 66 corresponding to quarter portions of primary characters 62 through logical variable names.

Intermediate characters 66 that are used to form a primary character are associated with the corresponding primary character by mixed font programming 20. For example, character display routine 21, of mixed font programming 20, associates primary characters 62 of primary character set 60 with the corresponding intermediate characters 66 of intermediate character set 64. This association is performed using a "switch" and "case" function in the C-programming language.

Table 3 recites portions of an example of character display routine 21 with particularly pertinent portions in bold face type. In Table 3 the "case '1'" function is utilized to associate the variable names for the intermediate characters 66 that correspond to the upper left, upper right, lower left, and lower right positions of the primary characters 62 "1", and therefore associate the primary character 62 "1" with the intermediate characters 66 corresponding to the primary character 62 "1."

TABLE 3

Pertinent Portions of an Example of Character Display Routine 21

```
void mixdsize(unsigned char lin,unsigned char col,char *input_str,
    unsigned char video)
{
  unsigned int count = 0;
  char top_line[20 + 1] = {0};          /* top line to be printed */
  char btm_line[20 + 1] = {0};          /* btm line to be printed */
  static char top_char[3] = {0};        /* 2 top tiles of character */
  static char btm_char[3] = {0};        /* 2 btm tiles of character */
  static char cur_char;                 /* current character */
while (count < strlen(input_str))
  {
  memset(top_char,0,2);                 /* clear top_char */
  memset(btm_char,0,2);                 /* clear btm_char */
  cur_char = input_str[count];          /* next character */
  switch (cur_char)
      {
    case '0':
      top_char[0] = *TL_0;              /* Each large character is */
      top_char[1] = *TR_0;              /* constructed from four small */
      btm_char[0] = *BL_0;              /* "tiles". */
      btm_char[1] = *BR_0;
      break;
    case '1':
      top_char[0] = *TL_1;
      top_char[1] = *TR_1;
      btm_char[0] = *BL_1;
      btm_char[1] = *BR_1;
      break;
strcat(top_line, top_char);             /* add char to top line */
strcat(btm_line, btm_char);             /* add char to btm line */
count++;
}
```

In the example of character display routine 21 listed in Table 3, a variable having a name "input_str" stores a primary character string for display on display 12, and a variable having a name "cur_char" stores, in succession, each primary character 62 in the primary character string stored in "input_str." By using a "switch" and "case" function of the C programming language, each primary character 62 of the primary character string to be displayed, which is temporarily stored within the variable "cur_char," is associated with four intermediate characters 66 corresponding to the primary character 62 stored in the variable "cur_char." For example, if the variable "cur_char" stores the primary character 62 "1," the "case '1'" function detects that the variable "cur_char" stores the primary character 62 "1" and assigns the intermediate characters 66 that correspond to the primary character 62 "1," which are "TL_1," "TR_1," "BL_0," "BR_1," to temporary variables "top_char[o]," "top_char[1]," "btm_char[o]," and "btm_char[1]," respectively. These temporary variables are then used to produce character strings that are used to display a representation of the primary character string, as discussed in greater detail in conjunction with FIGS. 9A and 9B.

Therefore, according to the invention, a primary character 62 such as the letter "E" may be represented by, for example, four intermediate characters 66 representing a top left, a top right, a bottom left, and a bottom right portion of the primary character 62. Formation of a character or a character string utilizing intermediate characters 66 to form a representation of a character having large font size, such as representation 50 of the character "E" or representation 36 of the character string "MIXED," is described in greater detail in conjunction with FIGS. 9A and 9B. A complete listing of one example of character display routine 21 is provided below in TABLE 4.

TABLE 4

Example of Character Display Routine 21

```
void mixdsize(unsigned char lin,unsigned char col,char *input_str,
    unsigned char video)
{
strcat(top_line, top_char);          /* add char to top line */
strcat(btm_line, btm_char);          /* add char to btm line */
count++;
}
  unsigned int count = 0;
  char top_line[20 + 1] = {0};       /* top line to be printed */
  char btm_line[20 + 1] = {0};       /* btm line to be printed */
  static char top_char[3] = {0};     /* 2 top tiles of character */
  static char btm_char[3] = {0};     /* 2 btm tiles of character */
  static char cur_char;              /* current character */
while (count < strlen(input_str))
  {
  memset(top_char,0,2);              /* clear top_char */
  memset(btm_char,0,2);              /* clear btm_char */
  cur_char = input_str[count];       /* next character */
  switch (cur_char)
    {
    case '0':
      top_char[0] = *TL_0;           /* Each large character is */
      top_char[1] = *TR_0;           /* constructed from four small */
      btm_char[0] = *BL_0;           /* "tiles". */
      btm_char[1] = *BR_0;
      break;
    case '1':
      top_char[0] = *TL_1;
      top_char[1] = *TR_1;
      btm_char[0] = *BL_1;
      btm_char[1] = *BR_1;
      break;
    case '2':
      top_char[0] = *TL_2;
      top_char[1] = *TR_2;
      btm_char[0] = *BL_2;
      btm_char[1] = *BR_2;
      break;
```

TABLE 4-continued

Example of Character Display Routine 21

```
    case '3':
      top_char[0] = *TL_3;
      top_char[1] = *TR_3;
      btm_char[0] = *BL_3;
      btm_char[1] = *BR_3;
      break;
    case '4':
      top_char[0] = *TL_4;
      top_char[1] = *TR_4;
      btm_char[0] = *BL_4;
      btm_char[1] = *BR_4;
      break;
    case '5':
      top_char[0] = *TL_5;
      top_char[1] = *TR_5;
      btm_char[0] = *BL_5;
      btm_char[1] = *BR_5;
      break;
    case '6':
      top_char[0] = *TL_6;
      top_char[1] = *TR_6;
      btm_char[0] = *BL_6;
      btm_char[1] = *BR_6;
      break;
    case '7':
      top_char[0] = *TL_7;
      top_char[1] = *TR_7;
      btm_char[0] = *BL_7;
      btm_char[1] = *BR_7;
      break;
    case '8':
      top_char[0] = *TL_8;
      top_char[1] = *TR_8;
      btm_char[0] = *BL_8;
      btm_char[1] = *BR_8;
      break;
    case '9':
      top_char[0] = *TL_9;
      top_char[1] = *TR_9;
      btm_char[0] = *BL_9;
      btm_char[1] = *BR_9;
      break;
    case 'A':
      top_char[0] = *TL_A;
      top_char[1] = *TR_A;
      btm_char[0] = *BL_A;
      btm_char[1] = *BR_A;
      break;
    case 'B':
      top_char[0] = *TL_B;
      top_char[1] = *TR_B;
      btm_char[0] = *BL_B;
      btm_char[1] = *BR_B;
      break;
    case 'C':
      top_char[0] = *TL_C;
      top_char[1] = *TR_C;
      btm_char[0] = *BL_C;
      btm_char[1] = *BR_C;
      break;
    case 'D':
      top_char[0] = *TL_D;
      top_char[1] = *TR_D;
      btm_char[0] = *BL_D;
      btm_char[1] = *BR_D;
      break;
    case 'E':
      top_char[0] = *TL_E;
      top_char[1] = *TR_E;
      btm_char[0] = *BL_E;
      btm_char[1] = *BR_E;
      break;
    case 'F':
      top_char[0] = *TL_F;
      top_char[1] = *TR_F;
      btm_char[0] = *BL_F;
      btm_char[1] = *BR_F;
```

TABLE 4-continued

Example of Character Display Routine 21

```
    break;
  case 'G':
    top_char[0] = *TL_G;
    top_char[1] = *TR_G;
    btm_char[0] = *BL_G;
    btm_char[1] = *BR_G;
    break;
  case 'H':
    top_char[0] = *TL_H;
    top_char[1] = *TR_H;
    btm_char[0] = *BL_H;
    btm_char[1] = *BR_H;
    break;
  case 'I':
    top_char[0] = *TL_I;
    top_char[1] = *TR_I;
    btm_char[0] = *BL_I;
    btm_char[1] = *BR_I;
    break;
  case 'J':
    top_char[0] = *TL_J;
    top_char[1] = *TR_J;
    btm_char[0] = *BL_J;
    btm_char[1] = *BR_J;
    break;
  case 'K':
    top_char[0] = *TL_K;
    top_char[1] = *TR_K;
    btm_char[0] = *BL_K;
    btm_char[1] = *BR_K;
    break;
  case 'L':
    top_char[0] = *TL_L;
    top_char[1] = *TR_L;
    btm_char[0] = *BL_L;
    btm_char[1] = *BR_L;
    break;
  case 'M':
    top_char[0] = *TL_M;
    top_char[1] = *TR_M;
    btm_char[0] = *BL_M;
    btm_char[1] = *BR_M;
    break;
  case 'N':
    top_char[0] = *TL_N;
    top_char[1] = *TR_N;
    btm_char[0] = *BL_N;
    btm_char[1] = *BR_N;
    break;
  case 'O':
    top_char[0] = *TL_O;
    top_char[1] = *TR_O;
    btm_char[0] = *BL_O;
    btm_char[1] = *BR_O;
    break;
  case 'P':
    top_char[0] = *TL_P;
    top_char[1] = *TR_P;
    btm_char[0] = *BL_P;
    btm_char[1] = *BR_P;
    break;
  case 'Q':
    top_char[0] = *TL_Q;
    top_char[1] = *TR_Q;
    btm_char[0] = *BL_Q;
    btm_char[1] = *BR_Q;
    break;
  case 'R':
    top_char[0] = *TL_R;
    top_char[1] = *TR_R;
    btm_char[0] = *BL_R;
    btm_char[1] = *BR_R;
    break;
  case 'S':
    top_char[0] = *TL_S;
    top_char[1] = *TR_S;
    btm_char[0] = *BL_S;
```

TABLE 4-continued

Example of Character Display Routine 21

```
    btm_char[1] = *BR_S;
    break;
  case 'T':
    top_char[0] = *TL_T;
    top_char[1] = *TR_T;
    btm_char[0] = *BL_T;
    btm_char[1] = *BR_T;
    break;
  case 'U':
    top_char[0] = *TL_U;
    top_char[1] = *TR_U;
    btm_char[0] = *BL_U;
    btm_char[1] = *BR_U;
    break;
  case 'V':
    top_char[0] = *TL_V;
    top_char[1] = *TR_V;
    btm_char[0] = *BL_V;
    btm_char[1] = *BR_V;
    break;
  case 'W':
    top_char[0] = *TL_W;
    top_char[1] = *TR_W;
    btm_char[0] = *BL_W;
    btm_char[1] = *BR_W;
    break;
  case 'X':
    top_char[0] = *TL_X;
    top_char[1] = *TR_X;
    btm_char[0] = *BL_X;
    btm_char[1] = *BR_X;
    break;
  case 'Y':
    top_char[0] = *TL_Y;
    top_char[1] = *TR_Y;
    btm_char[0] = *BL_Y;
    btm_char[1] = *BR_Y;
    break;
  case 'Z':
    top_char[0] = *TL_Z;
    top_char[1] = *TR_Z;
    btm_char[0] = *BL_Z;
    btm_char[1] = *BR_Z;
    break;
  case '.':
    top_char[0] = *TL_DEC;
    top_char[1] = *TR_DEC;
    btm_char[0] = *BL_DEC;
    btm_char[1] = *BR_DEC;
    break;
  case ',':
    top_char[0] = *TL_COM;
    top_char[1] = *TR_COM;
    btm_char[0] = *BL_COM;
    btm_char[1] = *BR_COM;
    break;
  case '-':
    top_char[0] = *TL_NEG;
    top_char[1] = *TR_NEG;
    btm_char[0] = *BL_NEG;
    btm_char[1] = *BR_NEG;
    break;
  case '+':
    top_char[0] = *TL_POS;
    top_char[1] = *TR_POS;
    btm_char[0] = *BL_POS;
    btm_char[1] = *BR_POS;
    break;
  case '#':
    top_char[0] = *TL_NUM;
    top_char[1] = *TR_NUM;
    btm_char[0] = *BL_NUM;
    btm_char[1] = *BR_NUM;
    break;
  case '$':
    top_char[0] = *TL_DOL;
    top_char[1] = *TR_DOL;
```

TABLE 4-continued

Example of Character Display Routine 21

```
        btm_char[0] = *BL_DOL;
        btm_char[1] = *BR_DOL;
        break;
    case '%':
        top_char[0] = *TL_PER;
        top_char[1] = *TR_PER;
        btm_char[0] = *BL_PER;
        btm_char[1] = *BR_PER;
        break;
    case '!':
        top_char[0] = *TL_EXC;
        top_char[1] = *TR_EXC;
        btm_char[0] = *BL_EXC;
        btm_char[1] = *BR_EXC;
        break;
    case '?':
        top_char[0] = *TL_QUE;
        top_char[1] = *TR_QUE;
        btm_char[0] = *BL_QUE;
        btm_char[1] = *BR_QUE;
        break;
    default:
        top_char[0] = *TL_*BLANK;
        top_char[1] = *TR_*BLANK;
        btm_char[0] = *BL_*BLANK;
        btm_char[1] = *BR_*BLANK;
        break;
    }
    strcat(top_line, top_char);          /* add char to top line */
    strcat(btm_line, btm_char);          /* add char to btm line */
    count++;
    }
BiosPutStrStay( lin,col,strlen(top_line),top_line,video);
BiosPutStrStay(++lin,col,strlen(btm_line),btm_line,video);
};/* End of mixdsize() */
```

FIG. 9A is a flowchart, showing exemplary steps associated with representing a character string according to the teachings of the present invention. FIG. 9B is associated with FIG. 9A illustrating a representation of a character string "EDS" according to the exemplary steps shown in FIG. 9A. As described above, the example of character display routine 21 recited in Table 4 associates a primary character in a primary character string to be displayed with four intermediate characters corresponding to the primary character and stores the four intermediate characters in four temporary variables. Display of a primary character through the use of intermediate characters is described below in conjunction with FIGS. 9A and 9B.

The example of character display routine 21 illustrated in Table 4 allows the representation of primary characters in display 12 utilizing intermediate characters selected from an intermediate character set, such as the intermediate character set illustrated in FIGS. 4 through 8. As a first step in displaying a primary character string in a large font, the example of character display routine 21 illustrated in Table 4 receives four parameters: a line number of the desired location for display of a primary character string, a column number of a left edge of the desired location for display of the primary character string, a string value to be displayed in a large font size, and the video mode of the string. The video mode of the string corresponds to whether a string will be displayed in normal or reverse mode. The receipt by the example of character display routine 21 illustrated in Table 4 of a character string, such as "EDS," is illustrated in FIG. 9A at step 102. A step 102 is implemented in the example of character display routine 21 illustrated in Table 4 by the function mixdsize (unsigned char lin, unsigned char col, char *input_str, unsigned char video).

Figure 5:
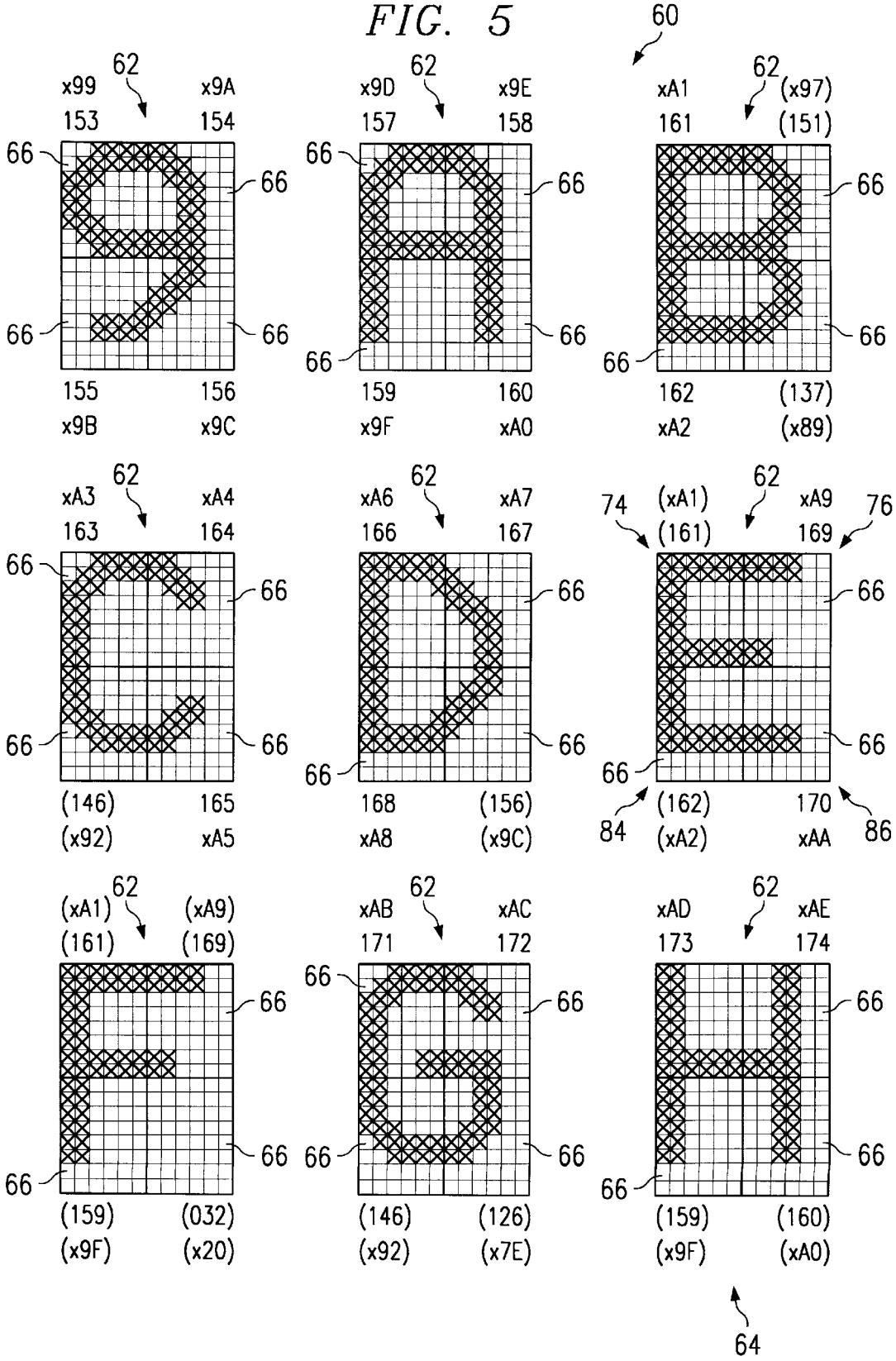
FIG. 5 illustrates the alphanumeric characters 9 and A through H and four intermediate characters for each alphanumeric character 9 and A through H, which form a part of a primary character set and an intermediate character set, respectively, according to the teachings of the present invention.
Figure 6:
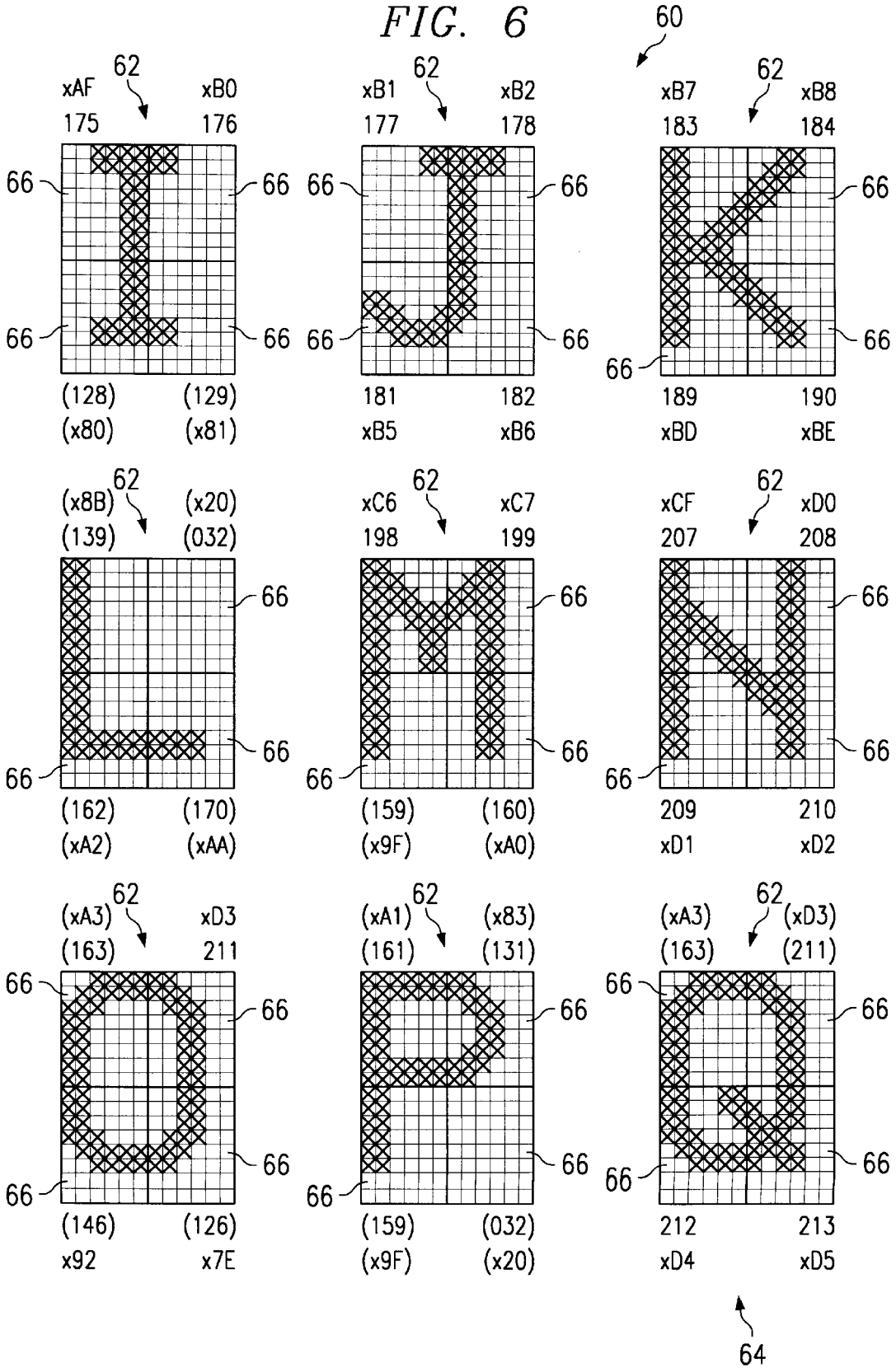
FIG. 6 illustrates the alphanumeric characters I through Q and the formation of four intermediate characters for each alphanumeric character I through Q, which form a part of a primary character set and an intermediate character set, respectively, according to the teachings of the present invention.
Figure 7:
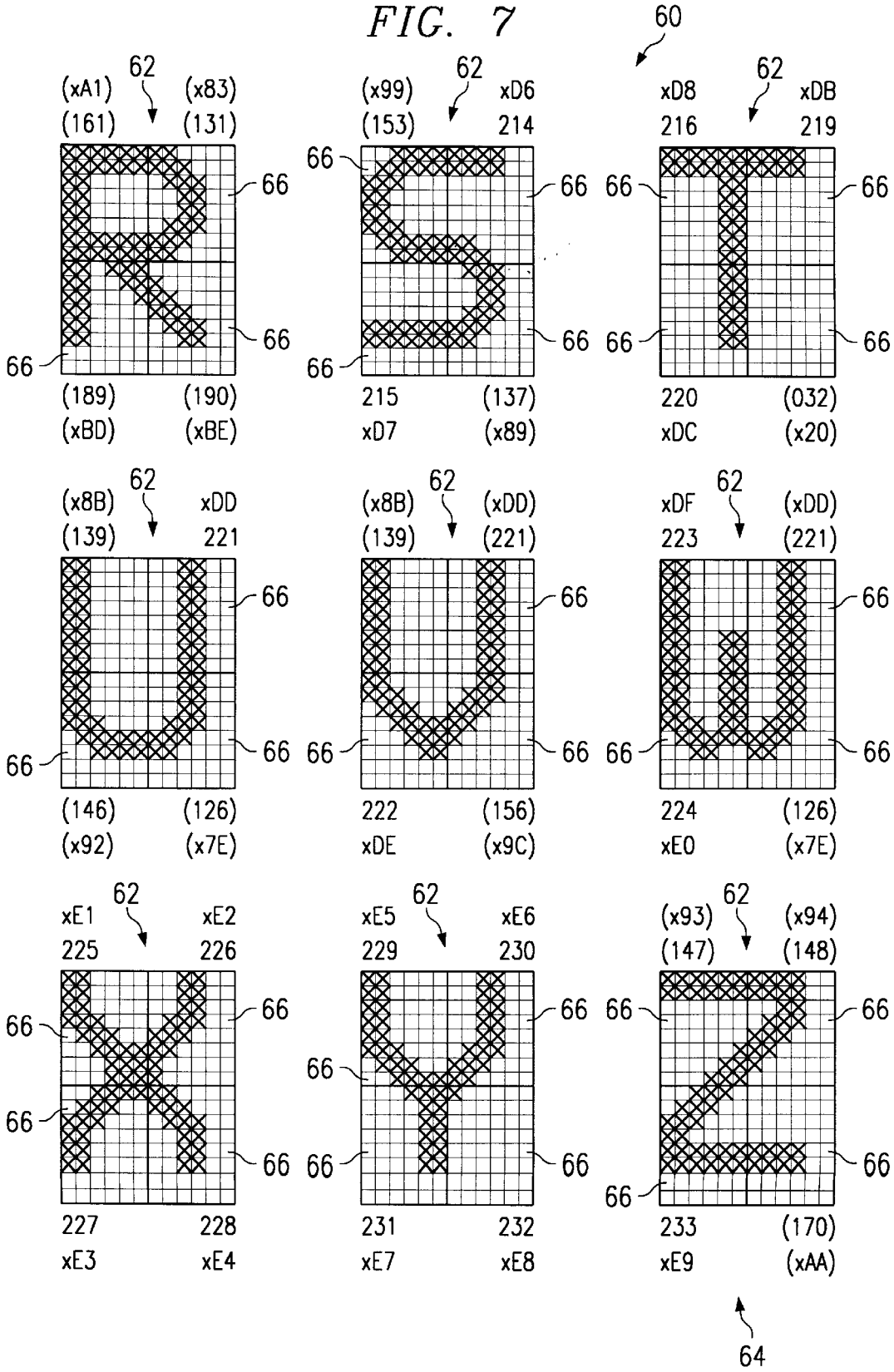
FIG. 7 illustrates the alphanumeric characters R through Z and four intermediate characters for each alphanumeric character R through Z, which form a part of a primary character set and an intermediate character set, respectively, according to the teachings of the present invention.
Figure 8:
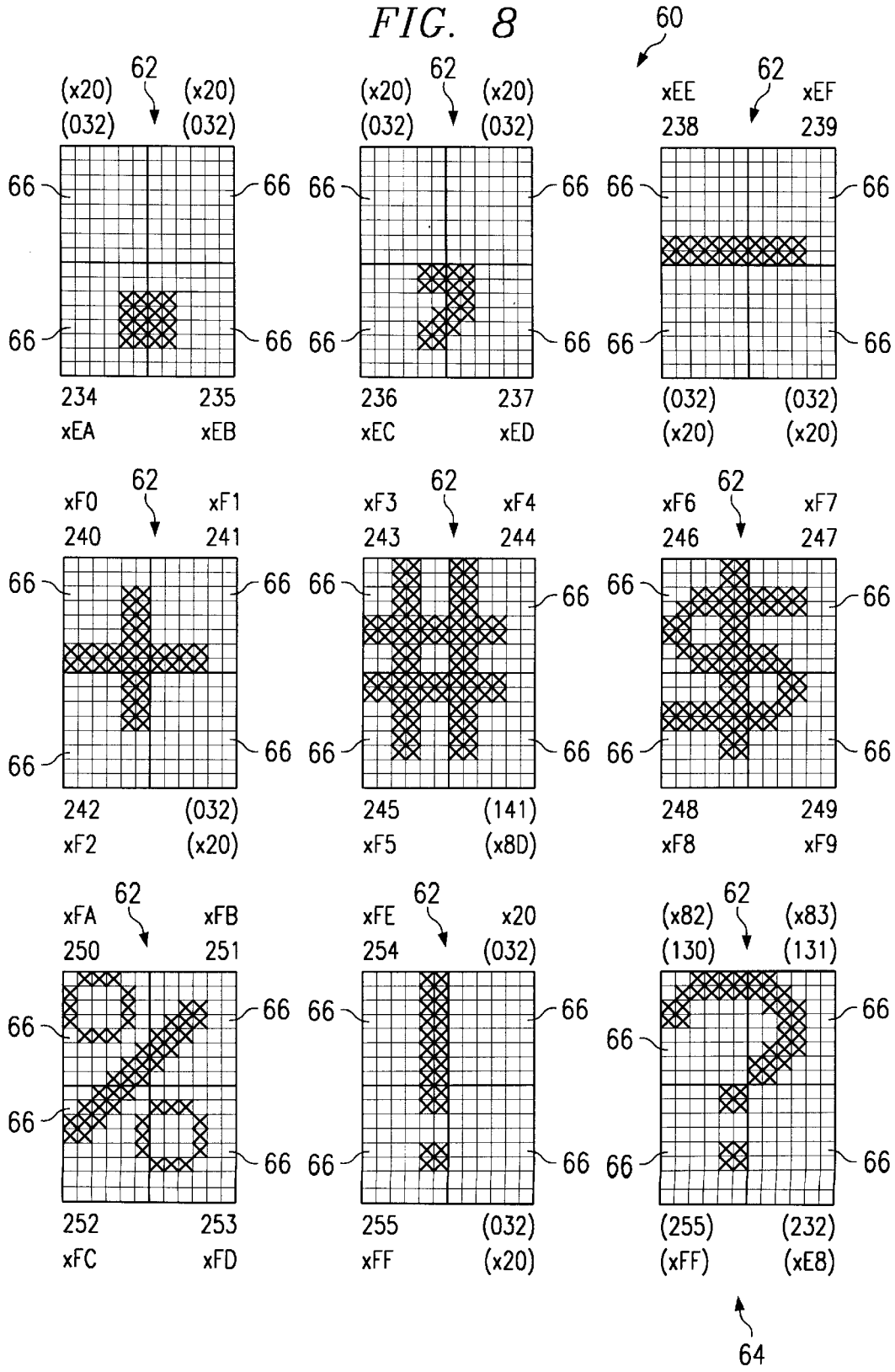
FIG. 8 is an illustration of a number of common punctuation characters and the formation of four intermediate characters corresponding to each punctuation character, which form a part of a primary character set and an intermediate character set, respectively, according to the teachings of the present invention.

At a step 104 a check is performed to determine if all characters within the desired character string have been examined. Step 104 is implemented in the example of character display routine 21 illustrated in Table 3 by the C programming language function "while (count<strlen (input_str))." If all characters in the primary character string have not been examined, a step 106 of identifying a next character in the character string is performed. For example, referring to FIG. 9B, the character string "EDS" is desired to be displayed in a large size font. Therefore, the example of character display routine 21 illustrated in Table 4 identifies the primary character "E" for display. In a step 108, two intermediate characters corresponding to the upper portion of the primary character "E" are selected. Representations 70 and 72 of the intermediate characters corresponding to the upper portion of primary character "E" are illustrated in FIG. 9B. The intermediate characters corresponding to the upper portion of the primary character "E" are illustrated in FIG. 5 and are identified by reference numerals 74 and 76.

At a step 110, the two intermediate characters corresponding to the lower portion of the primary character "E" are identified. Representations 80 and 82 of the lower left and lower right portions of the primary character "E" are illustrated in FIG. 9E. The intermediate characters corresponding to the lower left and lower right portions of the primary character "E" are illustrated in FIG. 5 and denoted by reference numerals 84 and 86, respectively. The selection of the intermediate characters corresponding to the primary character "E" is performed as described above in connection with the description of the "switch" and "case" functions of the example of character display routine 21 illustrated in Table 4, and therefore the top left, top right, bottom left, and bottom right portions of the primary character "E" are assigned to temporary variables within the example of character display routine 21 illustrated in Table 3 having the variable names "top_char[o]," "top_char[1]," "btm_char [o]," and "btm_char[1]."

According to the invention, each of the intermediate characters corresponding to the upper portion of a primary character string are combined to produce an intermediate character string that will represent an upper portion of the received primary character string and will be used to facilitate representation of the received character string on display 12. In this example, at a step 112 intermediate characters 74 and 76 illustrated in FIG. 9B, which correspond to the upper portion of the primary character "E," are added to a variable that corresponds to an upper character string. Similarly, intermediate characters 84 and 86 illustrated in FIG. 5, which correspond to the lower portion of the primary character "E," are added to an intermediate character string in a variable corresponding to the intermediate character string representing the lower portion of the character string to be displayed. The adding of intermediate characters 84 and 86 is illustrated in FIG. 9A by a step 114. In the example of character display routine 21 illustrated in Table 3 the adding of intermediate characters is performed through the C programming language functions "strcat(top_line, top_char);" and "strcat(btm_line, btm_char);". This process is repeated until the end of the received character string is reached.

As illustrated in FIG. 9B, a representation 94 of the received character string is displayed on display 12 by displaying a representation of an intermediate character string corresponding to the upper portion of the received character string, which in this example is the upper portion of the character string "EDS." Such a representation is illustrated in FIG. 9B by a representation 96. The step of displaying an intermediate character string corresponding to portion of the primary character string at an appropriate location on display 12 is illustrated in FIG. 9A by a step 116. Similarly, an intermediate character string corresponding to the lower portion of the received character string "EDS" is displayed at an appropriate location. The step of displaying a string corresponding to the lower portion of the character string "EDS" is illustrated in FIG. 9A by a step 118. The representation of this intermediate character string is illustrated by a representation 98 of the lower character string corresponding to the lower half of the character string "EDS."

Thus, by utilizing an intermediate character set, such as intermediate character set 64, having characters representing fractional portions of a primary character set, a character-based display may display representations of primary characters in at least two different font sizes, as illustrated in FIG. 2.

Thus, it is apparent that there has been provided, in accordance with the present invention, a method and system that satisfies the advantages set forth above. Although an embodiment has been described in detail, it should be understood that various and numerous changes, substitutions, and alterations can be made herein without the departing from the scope of the present invention. Other examples of changes, substitutions, and alterations are readily ascertainable by one skilled in the art and could be made without departing from the spirit and scope of the present invention as defined by the following claims.

What is claimed is:

1. A method of displaying a representation of a character on a computer display, the method comprising the steps of:

receiving a first primary character string comprising at least one character selected from a primary character set;

receiving a first desired location for displaying a representation of the first primary character string;

generating a plurality of intermediate character strings corresponding to the first primary character string, the intermediate character strings comprising at least one intermediate character selected from a predefined intermediate character set, the predefined intermediate character set being defined before receiving the first primary character string to comprise a plurality of intermediate characters each corresponding to a fractional portion of a primary character in the primary character set; and displaying representations of the plurality of intermediate character strings on the computer display in locations sufficient to display the representation of the primary character string at the first desired location.

2. The method of claim 1, wherein the representation of the first primary character string comprises a representation of each primary character in the first primary character string, the representation of each primary character requiring a first number of display cells, the first number being at least two, and further comprising the steps of:

receiving a second primary character string comprising at least one character selected from the primary character set;

receiving a second desired location for displaying a representation of the second primary character string on the computer display; and displaying a representation of the second primary character string at the second desired location, the representation of the second primary character string including a representation of each primary character in the second primary character string, the representation of each primary character in the second primary character string requiring less than the first number of display cells.

3. The method of claim 1, and further comprising the step of associating a plurality of intermediate characters selected from the intermediate character set with a primary character from the primary character set to facilitate display of the representation of the first primary character string at the desired location.

4. The method of claim 3, wherein the step of associating a plurality of intermediate characters with a primary character comprises storing the plurality of intermediate characters in a plurality of respective variables in a computer program, the plurality of respective variables associated with the primary character.

5. The method of claim 3, wherein the step of associating a plurality of intermediate characters with a primary character comprises storing four intermediate characters in four respective variables in a computer program, the four intermediate characters corresponding to an upper-left, an upper-right, a lower-left, and a lower-right portion of the primary character, the four respective variables associated with the primary character.

6. The method of claim 1, wherein the intermediate character set comprises characters corresponding to a fractional portion of upper case characters "A" through "Z."

7. The method of claim 1, wherein the intermediate character set comprises characters corresponding to an upper left, an upper right, a lower left, and a lower right portion of upper case characters "A" through "Z."

8. The method of claim 1, wherein the step of generating a plurality of intermediate character strings further comprises the step of associating a plurality of intermediate characters with each other, the associated intermediate characters selected from the predefined intermediate character set, the associated intermediate characters forming an intermediate character string representing a fractional portion of a primary character in the primary character string.

9. The method of claim 1, wherein the step of generating a plurality of intermediate character strings further comprises:

associating first and second intermediate characters to form a first intermediate string, the first intermediate string corresponding to a top half of a primary character in the first primary character string, the first intermediate character corresponding to a top-left portion of the primary character in the first primary character string and the second intermediate character corresponding to the top-right portion of the primary character in the first primary character string; and associating third and fourth intermediate characters to form a second intermediate string, the second intermediate string corresponding to a bottom half of the primary character in the first primary character string, the third intermediate character corresponding to a bottom-left portion of the primary character in the primary character string and the fourth intermediate character corresponding to a bottom-right portion of the primary character in the primary character string.

10. The method of claim 9, wherein the step of displaying representations of the plurality of intermediate character strings on the computer display in locations sufficient to display the representation of the first primary character string at the desired location further comprises the step of displaying the first intermediate character string at a first location and displaying the second intermediate character string at a second location, the first location being adjacent and above the second location.

11. The method of claim 1, and further comprising the step of defining the predefined intermediate character set to comprise a plurality of intermediate characters, each corresponding to a fractional portion of a primary character in the primary character set.

12. A computerized system for displaying mixed-sized fonts, the system comprising:

a storage medium;

a processor coupled to the storage medium;

a display coupled to the processor; and a computer program stored in the storage medium, the computer program operable to run on the processor, the computer program further operable to:

receive a primary character string comprising at least one character selected from a primary character set;

receive a desired location for displaying a representation of the primary character string on the display;

form a plurality of intermediate character strings corresponding to the primary character string, each intermediate character string comprising a plurality of intermediate characters selected from an intermediate character set, the intermediate character set comprising characters corresponding to a fractional portion of the primary characters in the primary character set; and display representations of the plurality of intermediate character strings on the computer display in locations sufficient to display the representation of the primary character string at the desired location.

13. The system of claim 12, wherein the intermediate character set comprises characters corresponding to an upper left, an upper right, a lower left, and a lower right portion of upper case characters "A" through "Z."

14. The system of claim 12, wherein the computer program is further operable to, for each character in the primary character set, assign to a plurality of respective variables in the computer program a plurality of intermediate characters corresponding to the primary character in the primary character set.

15. The system of claim 12, wherein the plurality of intermediate character strings comprises first and second intermediate character strings and wherein the computer program is further operable to display a first intermediate character string at a first location and display a second intermediate character string at a second location, the first location being adjacent and above the second location.

16. A portable data terminal comprising:

a storage medium storing a primary character set, the primary character set comprising a plurality of primary characters, the storage medium also storing a predefined intermediate character set comprising a plurality of intermediate characters, each intermediate character corresponding to a fractional portion of a primary character in the primary character set;

a processor coupled to the storage medium;

a display coupled to the processor, the display having a plurality of cells; and a computer program stored in the storage medium, the computer program operable to run on the processor, the computer program further operable to:

receive first and second primary character strings each comprising at least one character selected from a primary character set;

receive first and second desired locations for displaying representations of the first and second primary character strings, respectively, on the display;

assign to a variable in the computer program, for each character in the first primary character string, an intermediate character corresponding to an upper-left portion of the primary character in the primary character set;

generate a plurality of intermediate character strings corresponding to the first primary character string, each intermediate character string comprising a plurality of intermediate characters selected from the predefined intermediate character set;

display representations of the plurality of intermediate character strings on the computer display in locations sufficient to display the representation of the first primary character string at the desired location, the representation of the first primary character string including a representation of each primary character in the first primary character string, the representation of each primary character requiring a first number of cells, the first number being at least two; and display a representation of the second primary character string at the second desired location, the representation of the second primary character string including a representation of each primary character in the second primary character string, the representation of each primary character in the second primary character string requiring less than the first number of cells.

17. The portable data terminal of claim 16, wherein the computer program is further operable to:

associate first and second intermediate characters to form a first intermediate string, the first intermediate string corresponding to a top half of a primary character in the first primary character string, the first intermediate character corresponding to a top-left portion of the primary character in the first primary character string and the second intermediate character corresponding to the top-right portion of the primary character in the first primary character string; and associate third and fourth intermediate characters to form a second intermediate string, the second intermediate string corresponding to a bottom half of the primary character in the first primary character string, the second intermediate character corresponding to a bottom-left portion of the primary character in the primary character string and the second intermediate character corresponding to a bottom-right portion of the primary character in the primary character string.

18. The portable data terminal of claim 16, wherein the display comprises 160 cells configured in eight rows and twenty columns.

19. The portable data terminal of claim 16, wherein the display comprises 80 cells configured in four rows and twenty columns.

20. The portable data terminal of claim 18, wherein each cell comprises 48 pixels configured in eight rows and six columns.

* * * * *